US005442868A

United States Patent [19]

Ahn

[11] Patent Number: 5,442,868

[45] Date of Patent: Aug. 22, 1995

[54] METHOD FOR CONTROLLING OPERATION OF AN EXCAVATOR HAVING ELECTRONIC MICRO-MODULE

[75] Inventor: Seong-Ho Ahn, Seoul, Rep. of Korea

[73] Assignee: Samsung Heavy Industries Co., Ltd., Rep. of Korea

[21] Appl. No.: 168,507

[22] Filed: Dec. 22, 1993

[30] Foreign Application Priority Data

Jun. 30, 1993 [KR] Rep. of Korea ..... 93-12198

[51] Int. Cl.[6] ..... E02F 9/24

[52] U.S. Cl. ..... 37/348; 172/2; 364/424.07

[58] Field of Search ..... 37/348, 116, 103, 907; 364/424.07, 167.01; 91/DIG. 1; 92/12.1

[56] References Cited

U.S. PATENT DOCUMENTS

| | | | |
|---|---|---|---|
| 3,703,931 | 11/1972 | Page et al. | 37/348 X |
| 4,288,196 | 9/1981 | Sutton, II | 37/907 X |
| 4,864,746 | 9/1989 | Fukumoto | 37/907 X |
| 4,910,673 | 3/1990 | Marisawa et al. | 37/348 X |
| 4,934,462 | 6/1990 | Takara et al. | 37/348 X |
| 5,116,186 | 5/1992 | Hamamoto | 37/348 X |

FOREIGN PATENT DOCUMENTS 692950 10/1979 U.S.S.R. ..... 37/348

*Primary Examiner*—Randolph A. Reese
*Assistant Examiner*—Robert Pezzuto
*Attorney, Agent, or Firm*—Antonelli, Terry, Stout & Kraus

[57] ABSTRACT

The present invention relates to a method for automatically controlling the speed ratio of swing and boom operation of the excavator, which makes the operator perform the dig-up task in a easy and precise manner by adapting an electronic control using micro-module and sensors and so forth. The controlling method according to the present invention utilizes the angular velocity for the swing and the boom operation which is dependent on the position of the truck and is preset by the operator in the input/output board of the controller. When the dig-up task is performed, the operator will operate the joy sticks for the swing and the boom as much as possible and the controller enables the swing operation to move to the desired position without dropping a lump of earth. Again, when the operator operates the joy sticks for the dipper and the bucket in the same manner, the dipper and the bucket will move to the position in which the truck is placed.

5 Claims, 3 Drawing Sheets

METHOD FOR CONTROLLING OPERATION OF AN EXCAVATOR HAVING ELECTRONIC MICRO-MODULE

BACKGROUND OF THE INVENTION

1. Field of the Invention

The present invention relates to a method for controlling operation of an excavator and, more particularly, to a method for automatically controlling the speed ratio of swing and boom operation of the excavator, which makes the operator perform a digging operation in an easy manner.

2. Description of the Prior Art

A conventional excavator includes, as shown in attached drawing FIG. 3, a boom 1 coupled to the main body, a dipper 2 connected with the boom 1 by a rotating pin, and a bucket 3 coupled to the dipper. Further, there is provided a boom cylinder 4 to couple the boom 1 with the main body. Also, a dipper cylinder 5 is provided to couple the dipper 2 with the boom 1 and a bucket cylinder 6 to couple the bucket with the dipper 2. The cylinders 4, 5, and 6 have pistons for moving the boom 1, the dipper 2, and the bucket 3.

The operation of the excavator is performed by manipulating control levers or joy sticks so that the respective fluid valves controlling the movement of the boom 1, the dipper 2, and the bucket 3 and the rotation of the main body may be controlled to move each cylinder piston in accordance with the quantitative displacement of the fluid (the movement of the operating oil) provided at both sides of each cylinders 4, 5, and 6.

With the enhanced reliability of the electronic components and as the technology regarding sensors has developed, a new field of art called mechatronics is applied throughout the industrial machine.

As such technology is applicable to heavy equipment, an attempt has been made to generalize the application of electronic control to an excavator, a crane, a bulldozer and so forth, in the form of the hydronics which is the combination of hydrodynamics and electronics.

Despite the fact that the most popular equipment is the excavator, its usage is relatively more difficult than that of the other equipments, which results in a shortage of skilled operator for the excavator.

Therefore, with the application of electronic control to the conventional hydraulic excavator, by using microprocessors, electromagnetic proportional valves, and electronic sensors, it becomes possible to operate the excavator in an easy and speedy manner even if it is operated by an unskilled operator.

Especially, when the operator runs the excavator of the conventional type to perform a digging operation to manipulate the bucket of the excavator to dig up the earth and place it into a dump truck, the digging operation proceeds depending upon the experience of the operator by manipulating four joy sticks for controlling the swing of the main body and the movement of the boom, the dipper and the bucket.

Such a digging operation continuously performed by a manual operation, is boring and ineffective for the unskilled operator. To solve this problem, it is also proposed that the above-mentioned electronic control be incorporated into the conventional excavator.

SUMMARY OF THE INVENTION

Therefore, it is an object of the present invention to provide a method for automatically controlling the speed ratio of swing and boom operation of an excavator in which the digging operation can be carried out in an easy and precise manner even if it is operated by an unskilled operator.

The controlling method according to the present invention utilizes the angular velocity for the swing and the boom operation which is dependent on the position of the truck and is preset by the operator in the input/output board of the controller. When the digging operation is performed, the operator operates the joy sticks for the swing and the boom as much as possible and the controller enables the swing operation to move to the desired position without dropping earth. Again, when the operator operates the joy sticks for the dipper and the bucket in the same manner, the dipper and the bucket will move to the position where the truck is placed.

In achieving the above objects, the present invention resides in a method for automatically controlling the speed ratio of swing and boom operation of the excavator comprising the steps of:

calculating a required speed value at joints of a plurality of the excavator according to a manipulation amount of the joy sticks by the operator, in which an electrical signal corresponds to the amount of operation of each joy stick which is converted into the digital data by an A/D converter and transferred to a main processor;

determining a speed ratio of the boom and the swing operation of the excavator such that a speed value of a joint of each actuator is set to a minimum speed when a manipulation degree of the joy sticks is at minimum rate, and otherwise the speed value is set to maximum speed;

calculating an angular velocity of the swing operation in accordance with a determined speed ratio based on a boom angular velocity which is converted from a required boom cylinder speed when a determination of the priority operation of the boom is made;

calculating the boom angular velocity if the speed ratio is set into a swing priority, in accordance with the predetermined speed ratio based on a required angular velocity of the swing operation, and converting the boom angular velocity into a required boom cylinder speed;

determining a bucket maintenance angle related to a horizontal level if a joy stick for the bucket is manipulated, based on a current joint angle of the boom, the dipper, and the bucket as well as a bias angle read from joint sensors and a bias sensor;

calculating an object angle of the bucket for maintaining horizontal bucket angle if the joy stick for the bucket is not manipulated, based on the determined bucket maintenance angle;

transforming the object angle of the bucket into a desired object position of a cylinder of the bucket and calculating a required object speed of a bucket cylinder based on an object position and a current position of a bucket cylinder as Well as a current speed of the bucket cylinder;

determining an object speed of the bucket cylinder as well as the other cylinders such that a compensation is made for a speed error between a required object speed and a current speed of the cylinders calculated from a position detected by joint sensors; and calculating a required discharge amount of flow of pumps for moving each cylinder according to a calculated object speed of each cylinder, and providing control electrical signals for regulating control valves and for moving each cylinder with a desired speed.

BRIEF DESCRIPTION OF THE DRAWINGS

The above objects and other advantages of the present invention will become more apparent by describing in detail the preferred embodiment of the present invention with reference to the attached drawings in which.

DETAILED DESCRIPTION OF THE PREFERRED EMBODIMENT

Figure 1:
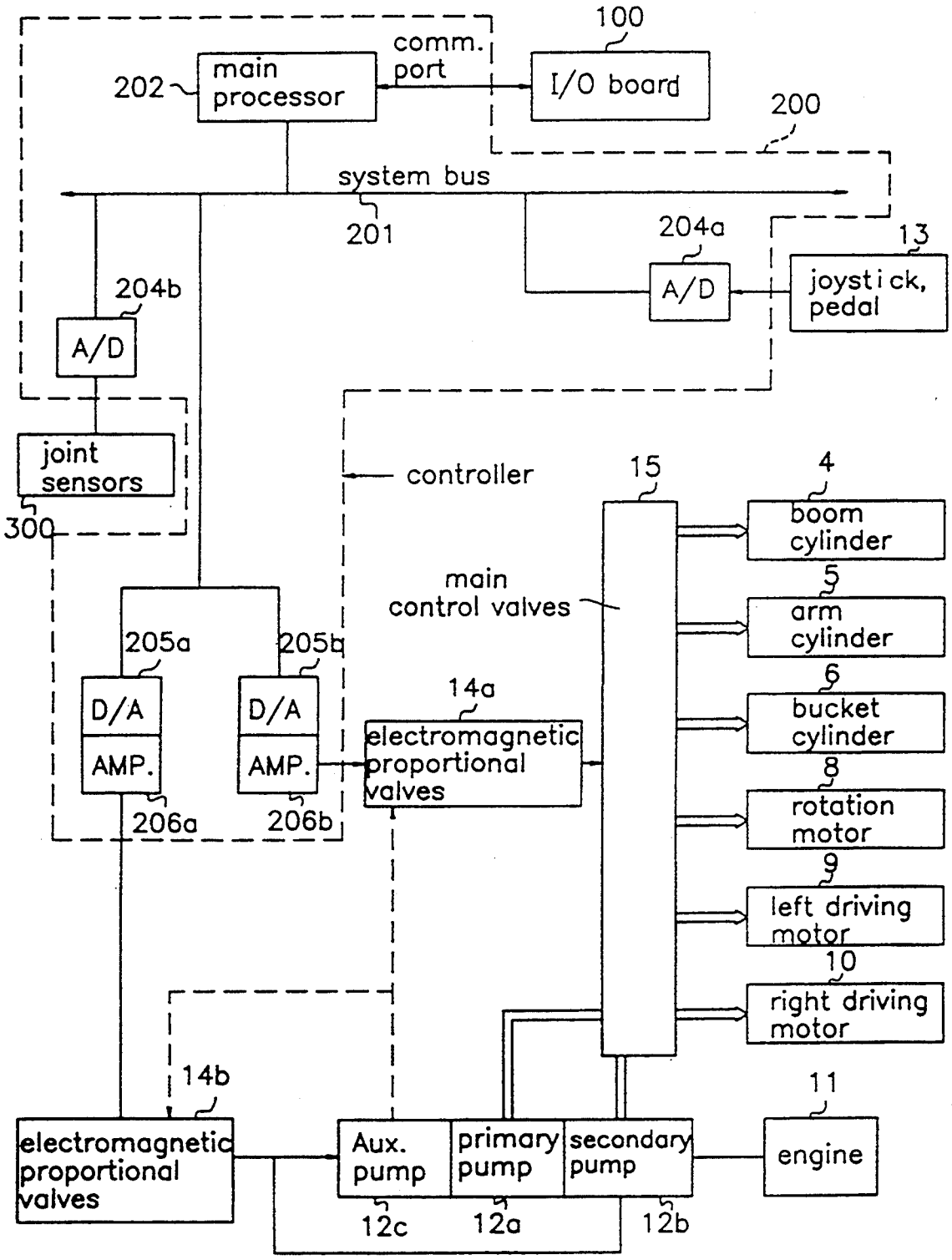
FIG. 1 is a schematic block diagram for illustrating the configuration of a control system for embodying the present invention which is incorporated in the major components of the excavator.

Referring to FIG. 1, there is shown a control system for embodying the present invention which is incorporated in the major components of an excavator. The disclosed major parts of the excavator are an actuator group such as a boom cylinder 4, a dipper (arm) cylinder 5, a bucket cylinder 6, a rotation motor 8, a left driving motor 9, and a right driving motor 10. In addition, reference numerals 11 and 12*a–c* denote an engine and associated pumps, respectively. Numeral 15 denotes the main control valves for controlling the fluid pressures supplied to the above actuator group, and numerals 14*a* and 14*b* denote electromagnetic proportional valves controlled by electrical signals provided by the control system as referred to later.

Further, two main pumps 12*a* and 12*b* generate the fluid pressures and a subsidiary pump 12*c* generates the pilot pressure, and the main control valves 15 consist of a plurality of control valves, the number of which corresponds to that of the components of the actuator group. Similarly, the number of the electromagnetic proportional valves 14*a* and 14*b* corresponds to the number of pumps and the main control valves 15.

Turning to the control system for embodying the present invention, it is comprised of a input/output board 100 which includes a data input and storage means and a display means for communicating with the operator; a control board 200 for carrying out the control operation; and a joint sensors 300 for detecting position of each of the joints of the excavator.

Referring again to FIG. 1, the control board 200 includes a main processor 202 connected with the input/output board 100 via a communication port and with the internal system bus 201, analog to digital (A/D) converters 204*a* and 204*b* for transforming the electrical signals provided by manual operation section 13 (includes the manual operating means such as joy sticks or pedals) and the joint sensors 300 into the respective digital data which is to be processed in the main processor 202, digital to analog (D/A) converters 205*a* and 205*b* for converting the instructive digital data provided by the main processor 202 via the system bus 201 to the respective analog voltage level signals, and amplifiers 206*a* and 206*b* for providing driving signals for the electromagnetic proportional valves 14*a* and 14*b*, respectively.

When the operator inputs instructions for a digging operation via the input/output board 100 by selecting a "swing, boom selection key" in the key pad, the instructions are transferred to the main processor 202 via the local bus. Then the main processor 202 reads in the data related to the speed ratio of swing and boom operation of the excavator which is previously stored in the input/output board 100.

At this time, when the operator manipulates the manual operating controls in order to move the actuators of the excavator, the electrical signals, which correspond to an amount of operation of each joy stick, are converted to digital data by the A/D converter 204*a* and transferred to the main processor 202.

Thus, the main processor 202 receives the digital data related to an amount of manual operations and calculates speed directive values related to each actuator, and then provides output digital signals representative of the speed directive values.

The output digital signals from the main processor 202 are converted to the analog voltage level signals by the D/A converters 205*a* and 205*b* and then are provided to each amplifier 206*a* and 206*b* in order to amplify the level of the digital output signals and to transform them into analog signals corresponding thereto.

The output current signals from each amplifier 206*a* and 206*b* are provided to the electromagnetic proportional valves 14*a* and 14*b* respectively for controlling the pumps 12*a–c* and the main control valves 15. Consequently, the first electromagnetic proportional valves 14*a* generate pilot pressures responsive to the incoming current analog signals and they are supplied to each swash plate (not shown) provided in each of the pumps 12*a* to 12*c*, in order to permit the bias degree of each swash plate to be properly regulated, and thereby to allow each pump to have the discharge rate corresponding to the respective bias degree of the swash plate.

Similarly, the second electromagnetic proportional valves 14*b* generate the pilot pressures responsive to the incoming current analog signals and they are supplied to each control valve (not shown) provided in the main control valves 15, in order to permit the spool stroke of each control valve to be properly regulated, and thereby to allow each valve to have the flow rate suited for driving the actuator group.

When the instruction for the starting of the digging operation is provided from the input/output board 100, the control board 200 reads out the data stored in the storage means of the board 100 and performs the predetermined control operation accordingly.

Figure 2:
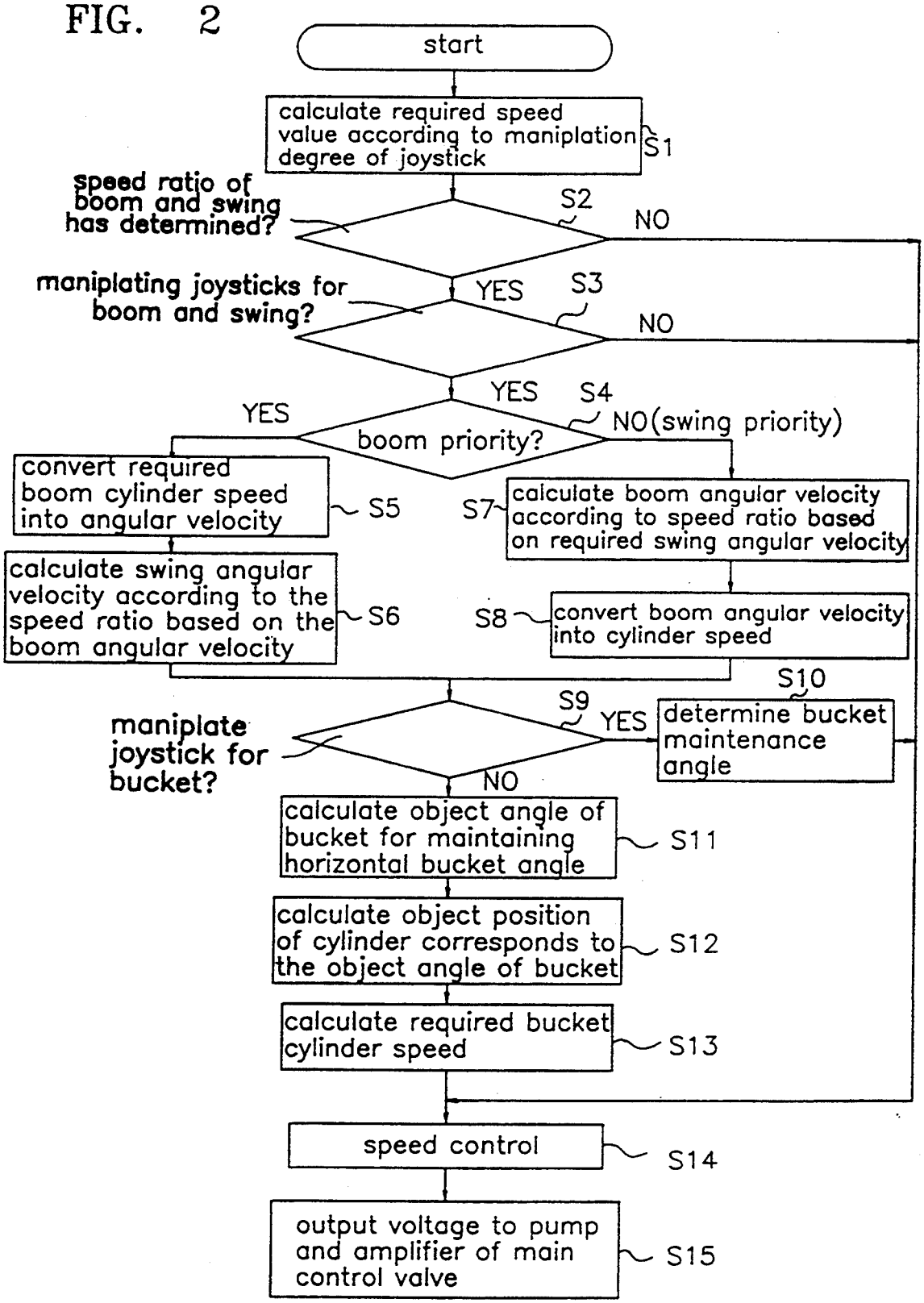
FIG. 2 is a flow chart illustrating the method according to the present invention.

From now on, the description will be made on how to control the operation of the digging operation with reference to the flow chart of FIG. 2.

First, when the operator manipulates the joy sticks, the electrical signals corresponding to an amount of operation of each joy stick are converted to digital data by the A/D converter 204*a* and transferred to the main processor 202. The main processor 202 receives the data representing an operation amount and calculates the required speed value at the joints of each actuator according to the manipulation degree of the joy sticks at step S1.

Next at step S2, the speed ratio of swing and boom operation of the excavator is determined such that the speed value is set to the minimum speed when the manipulation degree of the joy sticks is at minimum rate, and otherwise the speed value is set to a maximum speed.

Next at decision point S3, a determination is made whether the joy sticks for operating the boom and swing are operated, and if the operation of the joy sticks is found, at decision point S4 the priority of operation between boom and swing is determined.

At decision point S4, if the operator has chosen the boom selection key, the control board will be set to the boom priority operation.

Figure 3:
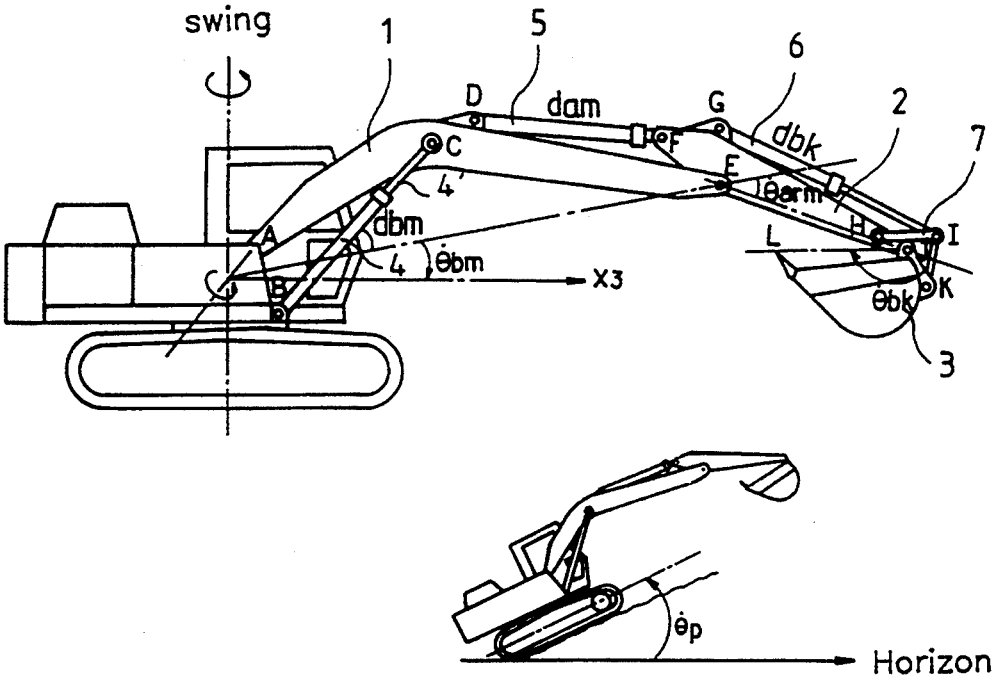
FIG. 3 is a side elevation of a conventional excavator.

At step S5 the required boom cylinder speed value ($d_{bm}$) calculated in step S1 is converted into the angular velocity ($\Theta_1$) in accordance with the following equation:

$$\Theta_4=(d_{bm}*d_{bm})/[(\text{LENAB}*\text{LENAC}*\sin(\text{ANGCAE}+\Theta_{bm}+\text{ANGBAX3})] \quad (1)$$

where, LENAB represents the linear length between joint A and joint B shown in FIG.3. Similarly, LENAC represents the linear length between joint A and joint C. Also, ANGCAE represents the angle between line CA and line AE, and $d_{bm}$ represents the length of the boom cylinder which is the linear length between joint B and joint C. ANGBAX3 represents the joint angle between line BA and horizontal line X3.

Figure 4:
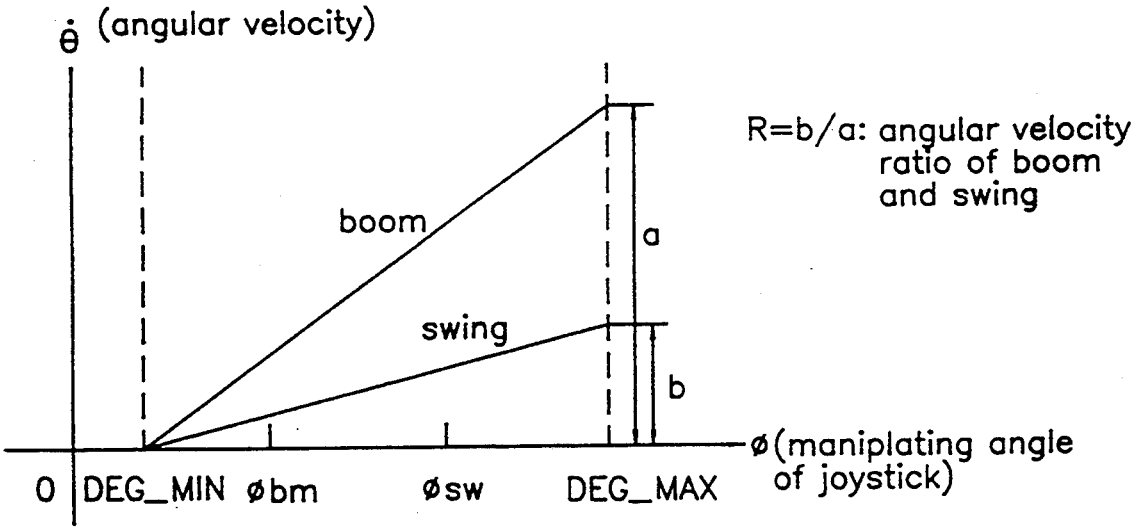
FIG. 4 is a functional graph representation of angular velocity related to the swing and the boom operation.

At step S6 an angular velocity for the swing operation is obtained in accordance with the predetermined speed ratio, as shown in the functional graph of FIG. 4, based on the boom angular velocity obtained at step S5.

If the manipulating angle of each joy sticks for the swing and the boom is the same, the operation of boom and swing is controlled in accordance with the predetermined speed ratio. Otherwise, the operation is not dependent on the predetermined speed ratio but depends on the linear speed function, resulting in a good operational feature. Consequently, when the operator manipulates the joy stick with a maximum degree of operation, the operation of the boom and swing is performed by maintaining the speed ratio at the maximum speed.

The angular velocity for the swing operation ($\Theta_{sw}$) can be obtained by the following equation:

$$\Theta_{sw}=\Theta_{bm}*R*[1+(\Theta_{sw}-\Theta_{bm})/(\Theta_{bm}-\text{DEGMIN})] \quad (2)$$

where, $\Theta_{bm}$ represents the angular velocity for the boom operation, R represents the angular velocity ratio for the predetermined boom and swing, $\Theta_{sw}$ represents the manipulation angle of the joy stick for the swing, and $\Theta_{bm}$ the angle of the joy stick for the boom operation. Also, DEGMIN represents the minimum manipulation angle of the joy sticks.

However, if the joy sticks are manipulated separately, the maximum angular velocity of the swing will be larger than that of the boom. Thus, the predetermined speed ratio stored in the I/O board can not be considered as the absolute angular velocity ratio. The absolute angular velocity ratio (N) for the boom and the swing can be represented by the following equation:

$$\Theta_{sw}=\Theta_{bm}*R*N*[1+(\Theta_{sw}-\Theta_{bm})/(\Theta_{bm}-\text{DEGMIN})] \quad (3)$$

In the meantime, if the speed ratio at decision point S4 is set for a swing priority, the boom angular velocity is calculated at step S7 in accordance with the speed ratio based on the required swing angular velocity. The boom angular velocity can be obtained from the following equation:

$$\Theta_{bm}=\Theta_{bm}*(1/N)*(1/R)*[1+(\Theta_{bm}-\Theta_{sw})/(\Theta_{sw}-\text{DEGMIN})] \quad (4)$$

At S8, the boom angular velocity ($\Theta_{bm}$) is converted into the boom cylinder speed ($d_{bm}$) in accordance with the following equation:

$$d_{bm}=\Theta_{bm}*\text{LENAB}*\text{LENAC}*\sin(\text{ANGCAE}+\Theta_{bm}+\text{ANGBAX3})/d_{bm} \quad (5)$$

where, LENAB represents the linear length between joint A and joint B shown in FIG.3. Similarly, LENAC represents the linear length between joint A and joint C. Also, ANGCAE represents the angle between line CA and line AE, and $d_{bm}$ the length of the boom cylinder which is the linear length between joint B and joint C. ANGBAX3 represents joint angle between line BA and horizontal line X3.

At decision point S9 a determination is made as to whether the joy stick for the bucket is manipulated.

If the joy stick for the bucket is manipulated, the bucket maintenance angle ($\phi$) is determined at step S10 based on the current joint angle of the boom ($\Theta_{bm}$), the dipper ($\Theta_{arm}$), and the bucket ($\Theta_{bk}$) as well as the bias angle ($\Theta_p$) read from the related joint sensors 300. The bucket maintenance angle ($\phi$) can be calculated from the following expression:

$$\phi=\Theta_{bm}+\Theta_{arm}+\Theta_{bk}+\Theta_p \quad (6)$$

If at step S9 it is determined that the joy stick for the bucket is manipulated, the object angle of the bucket for maintaining horizontal bucket angle is determined at step S11 based on the current joint angle of the boom ($\Theta_{bm}$) and the dipper ($\Theta_{arm}$) as well as the bias angle ($\Theta_p$) read from the related joint sensors 300 and the calculated bucket maintenance angle ($\phi$). The object angle of the bucket can be calculated from the following expression:

$$\Theta_{bk}=\phi-\Theta_{bm}-\Theta_{arm}-\Theta_p \quad (7)$$

After determining the object angle of the bucket for maintaining horizontal bucket angle, at step S12 the object angle of the bucket is transformed into the desired object position of its cylinder. That is, the joint angle ($\Theta_{bk}$) of the bucket is converted into the length ($d_{bk}$) of the bucket cylinder by using the following equations:

$$\alpha=\pi-(\Theta_0+\text{ANGLJK}+\text{ANGHJE}) \quad (8)$$

$$c6=\text{sqrt}[(\text{LENJK})^2+(\text{LENHJ})^2-2*\text{LENJK}*\text{LENHJ}*\cos(\alpha)] \quad (9)$$

$$\psi=a\cos\{(c6)^2+(\text{LENHI})^2-(\text{LENIK})^2\}/2*\text{LENHI}*c6 \quad (10)$$

$$\beta=a\cos\{(\text{LENHJ})^2+(c6)^2-(\text{LENJK})^2\}/2*\text{LENHJ}*c6 \quad (11)$$

$$\phi = ANG_GHJ - \psi - \beta \text{ ;if } \Theta_0 \geqq BK_ALGO_CHG_ANG \quad (12)$$

$$= ANG_GHJ - \psi + \beta \text{ ;if } \Theta_0 < BK_ALGO_CHG_ANG \quad (13)$$

$$d_{bk}=\text{sqrt}[(\text{LENGH})^2+(\text{LENHI})^2-2*\text{LENGH}*\text{LENHI}*\cos(\phi)] \quad (14)$$

In the above equations (8) to (14), for example, LENJK represents the linear length between joint J and joint K. Similarly, ANGLJK represents the angle between line LJ and line JK. Further, BKALGOCHGANG represents the joint angle of the bucket that will change the expression $\phi$, and ANGALPHA7 equals $\pi$−ANGJEF−ANGCED−ANGBEC. Also, sqrt represents a square root operator.

After completion of the above described transforming process, a precess for calculating the required object speed of the bucket cylinder based on the object position and current position of the bucket cylinder as well as the current speed of the bucket cylinder is performed at step 13.

Subsequently, the object speeds of the bucket cylinder as well as the other cylinders are controlled such that the speed error between the previously required object speed and the current speed of the cylinders sensed from the related joint sensors is compensated at step 14.

Finally, the required discharge amount of flow of the pumps necessary for achieving the above object speeds is calculated at step S15, with consideration of the calculated object speed of each cylinder, the discharge pressure of the pumps sensed by means of a pressure sensor, and the revolution rate of the engine sensed by a speed sensor.

The main processor 202 provides electrical signals which are corresponding to the calculated amount of flows, and they are supplied to the electromagnetic proportional valves 14*a* and 14*b* via D/A converters 205*a*, 205*b* and amplifiers 206*a*, 206*b* so as to regulate the main control valves 15 and to move each actuator (cylinders 4, 5, 6, swing motor 8 and driving motors 9, 10) with the desired speed.

As apparent from the foregoing, the present invention provides an electronic control of the speed ratio of swing and boom operation as intended by the operator. Thereby, the boom and swing operation according to the invention enables the excavator to perform the digging operation of the excavator without dropping earth in an easy and precise manner.

What is claimed is:

1. A method for automatically controlling a speed ratio of a swing and boom operation of an excavator comprising the steps:

calculating a required speed value at joints of a plurality of actuators of the excavator according to a manipulation amount of joy sticks controlled by an operator in which an electrical signal corresponding to an amount of operation of each joy stick is produced by each joy stick and is converted to digital data by an A/D converter coupled to the electrical signal produced by the joy stick and transferring the digital data to a processor of the excavator;

determining a speed ratio of the boom and the swing operation of the excavator such that a speed value of the joints of each actuator is set to a minimum speed when a manipulation degree of the joy sticks is at minimum rate, and otherwise the speed value is set to maximum speed;

calculating an angular velocity of the swing operation in accordance with the determined speed ratio based on a boom angular velocity which is converted from a required boom cylinder speed when a determination of a boom priority operation is made;

calculating a boom angular velocity if the determined speed ratio is set as a swing priority in accordance with the determined speed ratio based on the angular velocity of the swing operation, and converting the boom angular velocity into a required boom cylinder speed for moving the boom;

determining a bucket maintenance angle related to a horizontal level if a joy stick of a bucket of the excavator is manipulated, based on a current joint angle of the boom, a dipper, and the bucket and a bias angle read from joint sensors and a bias sensor;

calculating an object angle of the bucket for maintaining a horizontal bucket angle if the joy stick of the bucket is not manipulated based on the determined bucket maintenance angle;

transforming an object angle of the bucket into a desired object position of a bucket cylinder and calculating a required object speed of the bucket cylinder based on the desired object position and a current position of the bucket cylinder as well as a current speed of the bucket cylinder;

determining an object speed of the bucket cylinder and other cylinders of the excavator such that a compensation is made for a speed error between the object speed of the bucket cylinder and a current speed of the other cylinders calculated from a position of the other cylinders detected by the joint sensors; and calculating a required discharge amount of pressurized fluid from pumps for making .each of the cylinders move according to the calculated object speed of each cylinder, and providing control electrical signals for regulating control valves of the cylinders and for moving each actuator with a desired speed.

2. A method according to claim 1 further comprising:

the step of controlling the operation of boom and swing in accordance with the determined speed ratio if a manipulating angle of each joy stick of the swing and the boom is identical, and otherwise the operation varies depending on a linear speed function of the swing and boom.

3. A method according to claim 1 wherein the step for calculating a bucket maintenance angle related to the horizontal level comprises:

summing joint angles of the boom, dipper, the bucket and the bias angle.

4. A method according to claim 1 wherein the step for calculating an object angle of the bucket for maintaining horizontal bucket angle comprises:

subtracting joint angles of the boom, the dipper, and the bias angle from the determined bucket maintenance angle.

5. A method according to claim 1 wherein:

the control electrical signals corresponding to the required discharge amount of pressurized fluid from the pumps are supplied to electromagnetic proportional valves via D/A converters and amplifiers to regulate the valves and to move each cylinder, swing motor and driving motors with a desired speed.

* * * * *